US005697676A

United States Patent [19]

Kashima et al.

[11] Patent Number: 5,697,676

[45] Date of Patent: Dec. 16, 1997

[54] SHIELD TUNNEL BORING MACHINE

[75] Inventors: Yutaka Kashima; Norio Kondo; Masami Inoue, all of Tokyo, Japan

[73] Assignee: Daiho Corporation, Tokyo, Japan

[21] Appl. No.: 559,985

[22] Filed: Nov. 17, 1995

[30] Foreign Application Priority Data

Nov. 22, 1994 [JP] Japan ..... 6-314027

[51] Int. Cl.[6] ..... E21C 27/24; E21D 9/08

[52] U.S. Cl. ..... 299/60; 299/80.1

[58] Field of Search ..... 299/55, 60, 61, 299/80.1

[56] References Cited

U.S. PATENT DOCUMENTS

| | | | |
|---|---|---|---|
| 2,801,836 | 8/1957 | Risse | 299/80.1 X |
| 3,232,670 | 2/1966 | Robbins et al. | 299/61 X |
| 3,459,453 | 8/1969 | Brill et al. | 299/80.1 X |
| 3,653,716 | 4/1972 | Hattrup | 175/62 X |
| 3,830,545 | 8/1974 | Sugden | 299/56 X |
| 4,298,230 | 11/1981 | Krabbe | 299/58 X |
| 4,339,153 | 7/1982 | LeBegue et al. | 299/80.1 X |
| 4,406,498 | 9/1983 | Akesaka | 299/11 |
| 4,607,889 | 8/1986 | Hagimoto et al. | 299/33 |
| 4,998,776 | 3/1991 | Chida et al. | 299/61 X |

FOREIGN PATENT DOCUMENTS

| | | |
|---|---|---|
| 3216742 | 12/1983 | Germany . |
| 2091316 | 7/1982 | United Kingdom . |

*Primary Examiner*—David J. Bagnell
*Attorney, Agent, or Firm*—Lynn & Lynn

[57] ABSTRACT

A shield tunnel boring machine having a parallel link excavator includes excess excavating cutters joined to the excavator and divided into a plurality of steps. The excess excavating cutters of the respective steps are coupled to separate corresponding jacks that are actuatable and controlled independently of each other for allowing the position of the machine to be effectively controlled to be able to quickly correct any undesired change in direction of the tunnel boring operation.

6 Claims, 6 Drawing Sheets

SHIELD TUNNEL BORING MACHINE

BACKGROUND OF THE INVENTION

This invention relates to shield tunnel boring machines comprising a parallel link excavator which performs a rotary motion of parallel link arrangement and an excess excavator disposed to externally enclose at least part of the parallel link excavator.

DESCRIPTION OF RELATED ART

U.S. Pat. No. 4,607,889 to Hagimoto et al. and assigned to the present assignee discloses a shield tunnel boring excavator provided with a plurality of radially extending cutter spokes with many cutter bits mounted thereon.

Recently, improved shield tunnel boring machines having parallel link excavators have been developed. By using such shield tunnel boring machines, it is possible to provide a greater variety of operational modes of the cutter spokes than is possible with shield tunnel boring machines that have the cutter spokes extending only radially. The parallel link excavators provide remarkably improved cutting action in comparison to the cutting action attainable by means of the cutter bits mounted on the cutter spokes.

A problem that occurs in using shield tunnel boring machines is maintaining a desired boring direction. When the tunnel boring machine veers away from the desired direction, it is necessary to excavate more material from some portions of the tunnel face than others. The apparatus that provides the capability of correcting the tunnel boring direction by removing material at greater rates in some locations than others is referred to herein an excess excavation cutter. The prior art fails to disclose or suggest a shield tunnel boring machine having an excess excavating cutter system that satisfactorily corrects for a undesired changes in direction that may occur during tunnel boring operations.

Therefore, there is a need for a shield tunnel boring machine capable of providing effective excess excavation and direction control in a smooth manner to effectively correct for errors in the tunnel boring direction.

SUMMARY OF THE INVENTION

A primary object of the present invention is, therefore, to provide a shield tunnel boring machine that eliminates the foregoing described problem and which is capable of executing direction control in a smooth manner with the necessary excess excavation effectively accomplished to quickly correct for any deviation from the desired direction in the tunnel boring operation. In addition to providing the capability of adjusting the boring direction to correct errors, the present invention is also particularly useful for constructing a curved tunnel.

According to the present invention, the above objects are realized by means of a shield tunnel boring machine wherein a parallel link excavator including tunnel face cutters having cutter spokes with a plurality of cutter bits are mounted thereto is additionally provided with excess excavating cutters comprising cutter spokes to which a plurality of cutter bits are mounted for enabling an excess excavation to be executed during the excavation at the tunnel face, characterized in that the excess excavating cutters are divided into a plurality of steps, the excess excavating cutters of the respective steps being coupled mutually separately to jacks which are coupled to means for adjusting mutually independently the excess excavation rate of the cutters at the respective steps.

Other objects and advantages of the present invention shall be made clear in the following description of the invention detailed with reference to preferred embodiments shown in accompanying drawings.

While the present invention shall be described with reference to the respective embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Figure 1:
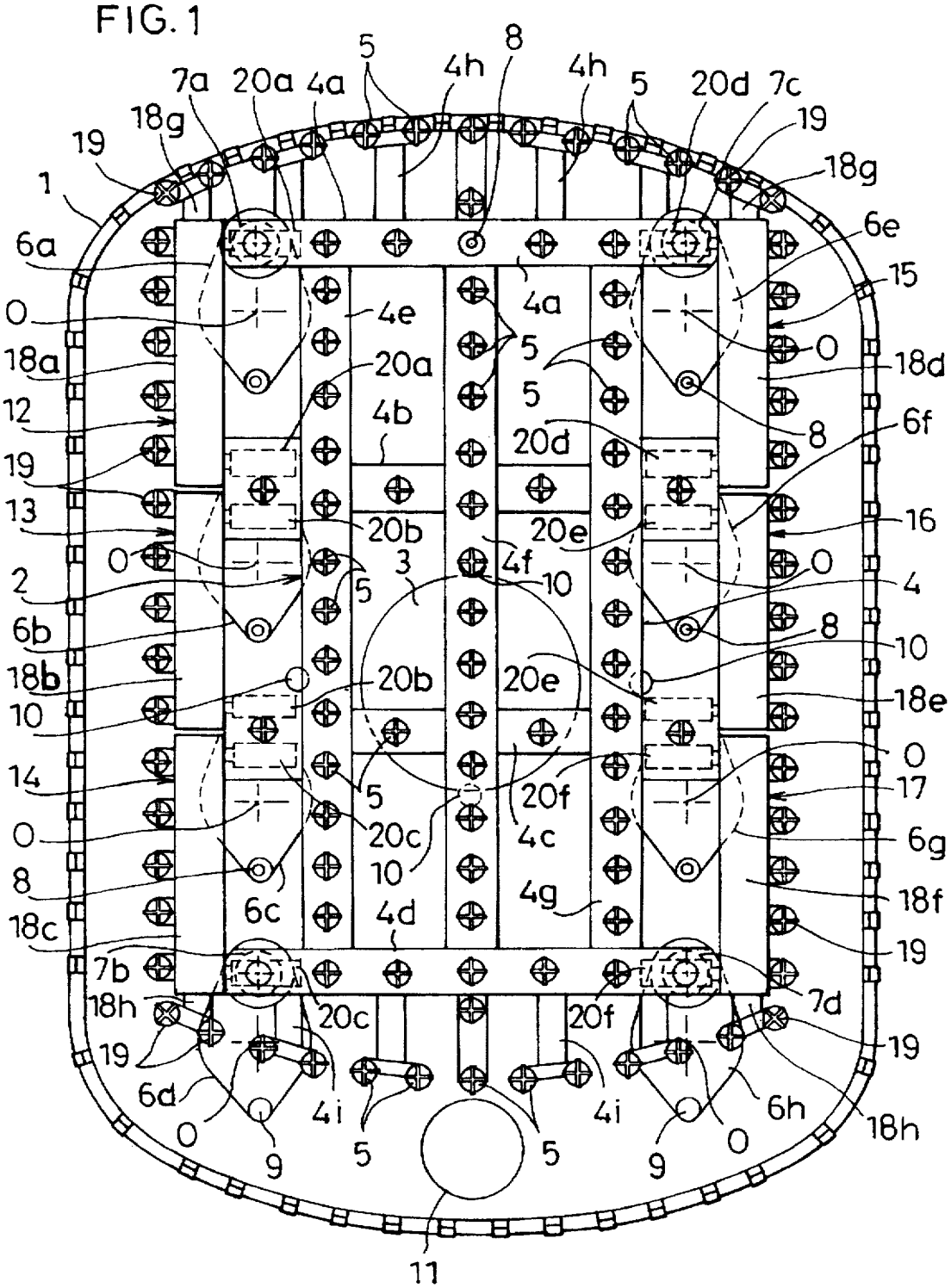
FIG. 1 is a front view of the shield tunnel boring machine in a first embodiment according to the present invention.

Referring to FIG. 1, there is shown a first embodiment of a shield tunnel boring machine according to the present invention, comprising a shield cylinder 1, a parallel link excavator 2, a mud discharger 11, and two sets of excess excavating cutters 12–14 and 15–17 disposed symmetrically on both sides of the parallel link excavator 2 with respect to its rotary axis to enclose at least part of the parallel link excavator 2. In the present embodiment of the invention, the shield cylinder 1 is formed to have a cross sectional outline that is substantially a squarish ellipse or a round-cornered rectangle similar to a track for track-and-field athletic events. The parallel link excavator 2 includes a motive rotor 3, a plurality of tunnel-face cutters 4, a plurality of cutter bits 5 mounted to the cutters 4, follower rotors *6a–6h*, and support shafts *7a–7d* coupling between the cutters 4 and the follower rotors *6a–6h*.

The motive rotor 3 may be coupled through reduction gears (not shown) to a rotary driving source, or motor, mounted to an inner bulkhead of the shield cylinder 1. Suitable bulkhead, rotary driving source and reduction structures are well-known in the art. The tunnel-face cutters 4 comprise a main part formed of a lattice formation of a plurality of horizontal cutter spokes *4a–4d* arranged to be mutually separated vertically (as viewed in FIG. 1) and a plurality of vertical cutter spokes *4e–4g* arranged to be mutually separated horizontally. The tunnel face cutters 4 further include a plurality of upper vertical cutter spokes *4h* disposed on the upper side of the topmost horizontal cutter spoke *4a* and arranged to be mutually separated at regular intervals. A plurality of lower vertical cutter spokes *4i* are disposed on the lower side of the lowermost horizontal cutter spoke *4d* and mutually separated at regular intervals. In the region where the cutter device 4 is disposed, at least one muddying material jet 8 and a corresponding mud pressure gauge 10 are provided. There may be more than one muddying material jet and mud pressure gauge as occasion demands. Further, the plurality of the cutter bits 5 are provided on the front side face of the respective cutter spokes 4a–4i of the cutters 4 respectively at optimum intervals.

The follower rotors 6a–6h are arranged in two sets, each of which sets including four rotors 6a–6d and 6e–6h to make a total of eight such rotors. The rotors 6a–6d and 6e–6h are arranged in the vertical direction on both sides of the parallel link excavator 2 as viewed from the front side of FIG. 1. The respective follower rotors 6a–6d and 6e–6h are coupled through a power transmission system such as a gear train (not shown) to the motive rotor 3 and are made rotatable about the point "O" as the rotary center mutually in synchronism and in the same direction. Kneading blades 9 for mixing excavated material with a muddying material jetted out of the muddying material jets 8 are provided for the follower rotors as necessary.

Further, the support shafts 7a–7d are respectively mounted to an eccentric position of corresponding one of the follower rotors 6a, 6d, 6e and 6h. Here, the respective support shafts 7a–7d are constituted so as to realize a support which allows the parallel link excavator 2 to rotate as a whole within the shield cylinder 1 in the operational aspect of the parallel link, in cooperation with each other of the respective support shafts 7a–7d.

The mud discharger 11 is provided in the shield cylinder 1 to open its mud inlet port in a tunnel face chamber (not shown) defined at the front end of the shield tunnel boring machine between the tunnel face and the bulkhead, in which chamber the excavator 2 is provided.

Further, the excess excavating cutters 12–14 and 15–17 on both lateral sides of the parallel link excavator 2 are divided into a plurality of steps in the front side view of FIG. 1. The respective cutters 12–14 and 15–17 comprise cutter spokes 18a–18c and 18d–18f of both side rows, upward cutter spokes 18g at the top position of the topmost side cutter spokes 18a and 18d, downward cutter spokes 18h at the lower position of the lowermost side cutter spokes 18c and 18f, a plurality of cutter bits 19 mounted to the cutter spokes 18a–18c and 18d–18f vertically oriented and upward and downward cutter spokes 18g and 18h, and jacks 20a–20c and 20d–20f provided in to the respective cutter spokes 18a–18c and 18d–18f, as coupled to an adjusting means (not shown) to be respectively mutually independently controllable. With this arrangement, the amount of excess excavation by means of the respective cutters 12–14 and 15–17 can be independently adjusted through expansion and contraction of the respective pairs of the jacks 20a–20c and 20d–20f.

Next, the operation of the shield tunnel boring machine according to the fast embodiment as has been described shall be explained. In boring a tunnel through the earth, the parallel link excavator 2 is actuated with a rotary output of the motive rotor 3. The eight follower rotors 6a–6d and 6e–6h are thereby driven through a power transmission system such as the gear train to rotate mutually in synchronism and in the same direction. At this time, with the interposition of the support shafts 7a–7d mounted to the eccentric position of the follower rotors 6a, 6d and 6e, 6h, the cutter spokes 4a–4f of the cutters 4 execute the parallel link rotation in a predetermined direction while maintaining the parallel link coupling state, and the tunnel face earth is excavated by the number of the cutter bits 5 mounted to the cutters 4. At the same time, the excess excavating cutters 12–14 and 15–17 on the both lateral caused to follow the motion of the parallel link excavator 2 to be thereby rotated, and the excess excavation can be attained in response to any demand with respect to the tunnel face material by means of the number of the cutter bits 19.

After the excavation of the tunnel face ground as has been described, a muddying material is jetted to the excavated material from the muddying material jet 8 as occasion demands. The excavated material is mixed with the muddying material by means of the kneading blades 9 to give the material viscosity so that it becomes muddy, to facilitate the discharge of the excavated material out of the shield tunnel boring machine.

Further, the mud pressure within the tunnel face chamber at the front end of the shield tunnel boring machine is monitored by the mud pressure gauge 10. The mud of the excavated ground formation is sequentially discharged by means of the mud discharger 11, while maintaining the mud pressure within the tunnel face chamber at a level capable of preventing the tunnel face from collapsing. After the excavation of the tunnel face ground for a predetermined zone, general purpose propelling jacks incorporated in the shield cylinder 1 are expanded for an extent sufficient to propel the shield cylinder 1 forward so that the tunnel boring operation may be resumed.

With the foregoing operation sequentially executed by the shield tunnel boring machine actuated and propelled forward, the tunnel is bored while the peripheral wall of the tunnel is covered in any known suitable manner.

Figure 2:
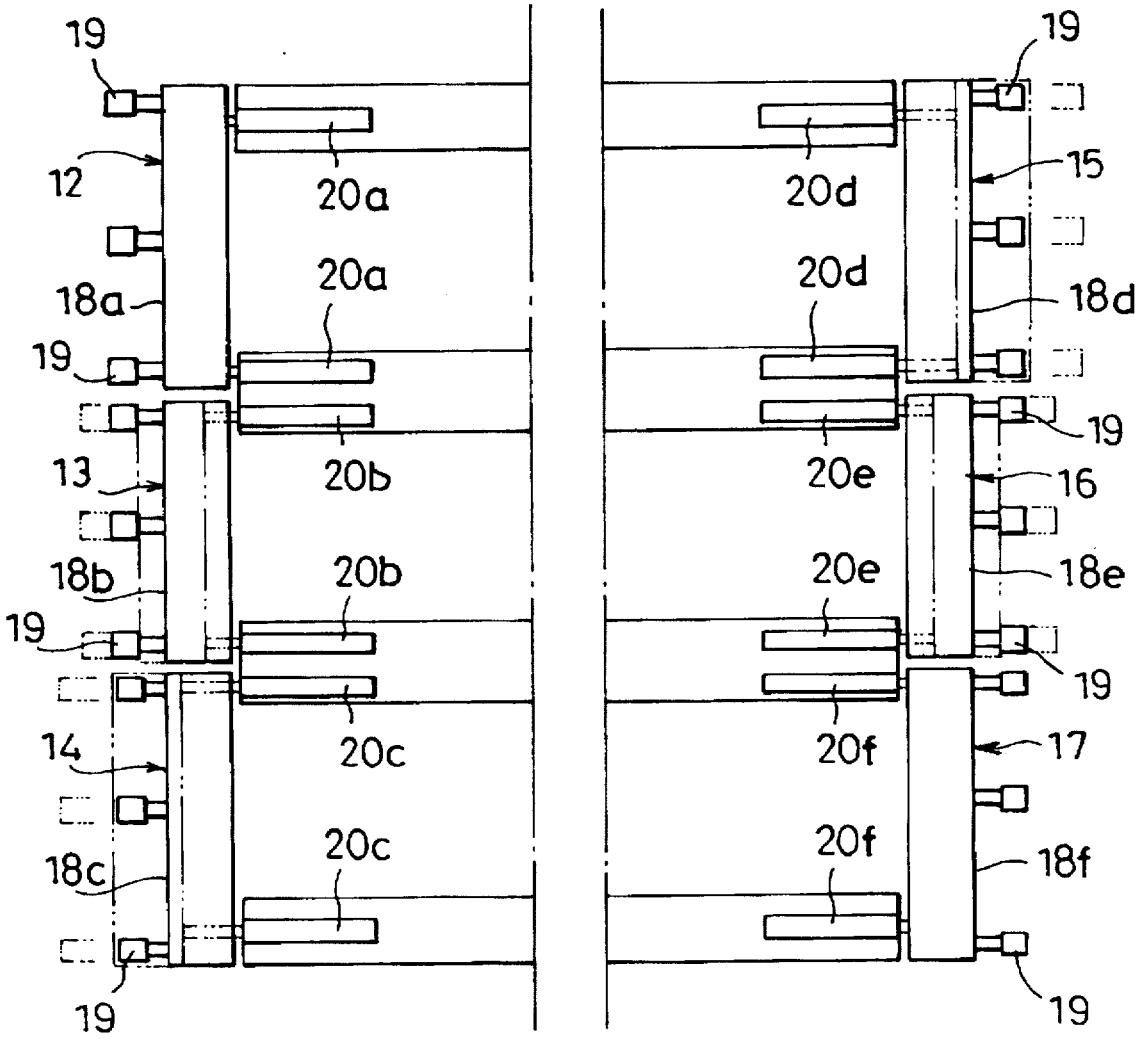
FIG. 2 is a fragmentary front view as magnified of a major part of the shield tunnel boring machine of FIG. 1.
Figure 3:
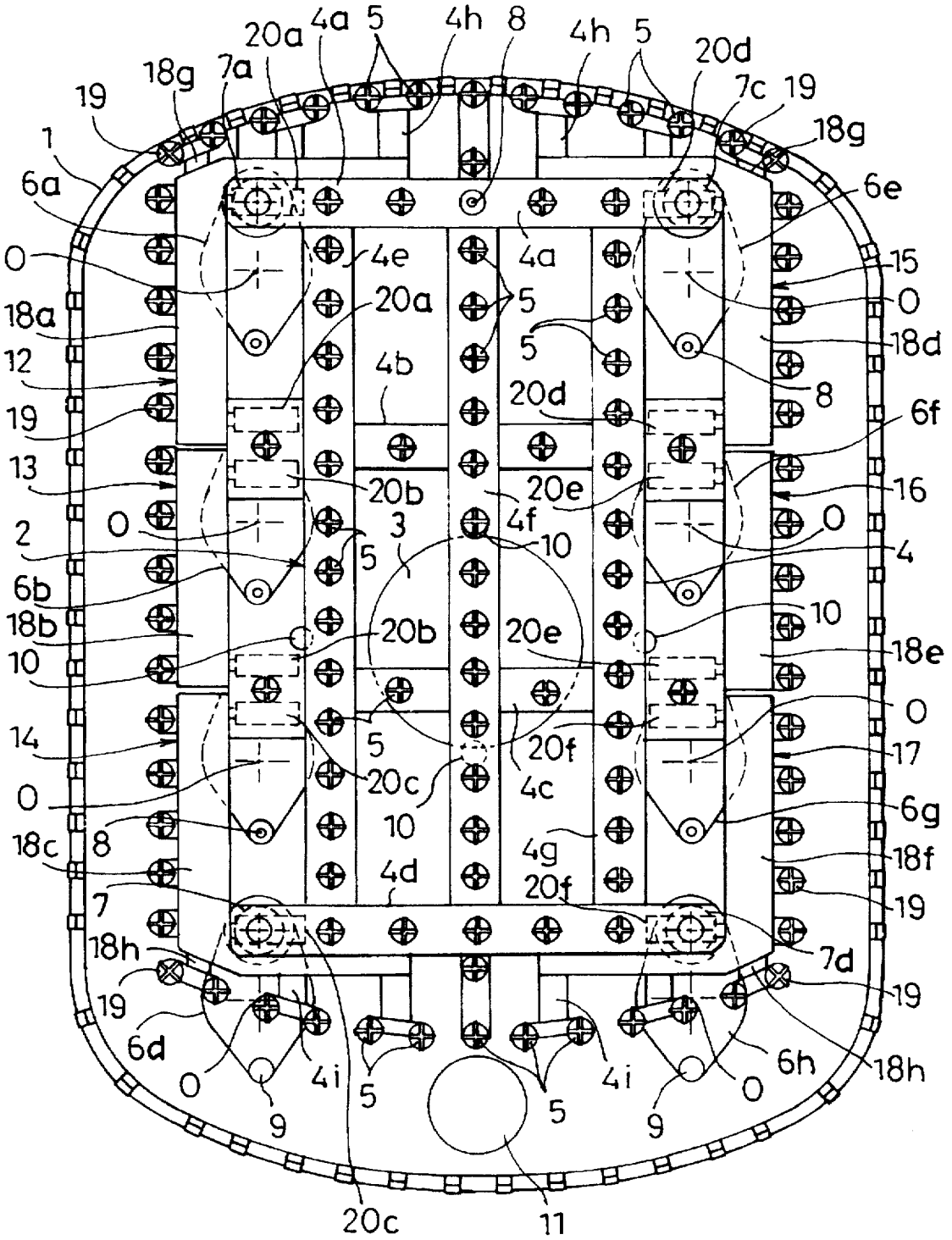
FIG. 3 is a front view of the shield tunnel boring machine in a second embodiment according to the present invention.
Figure 4:
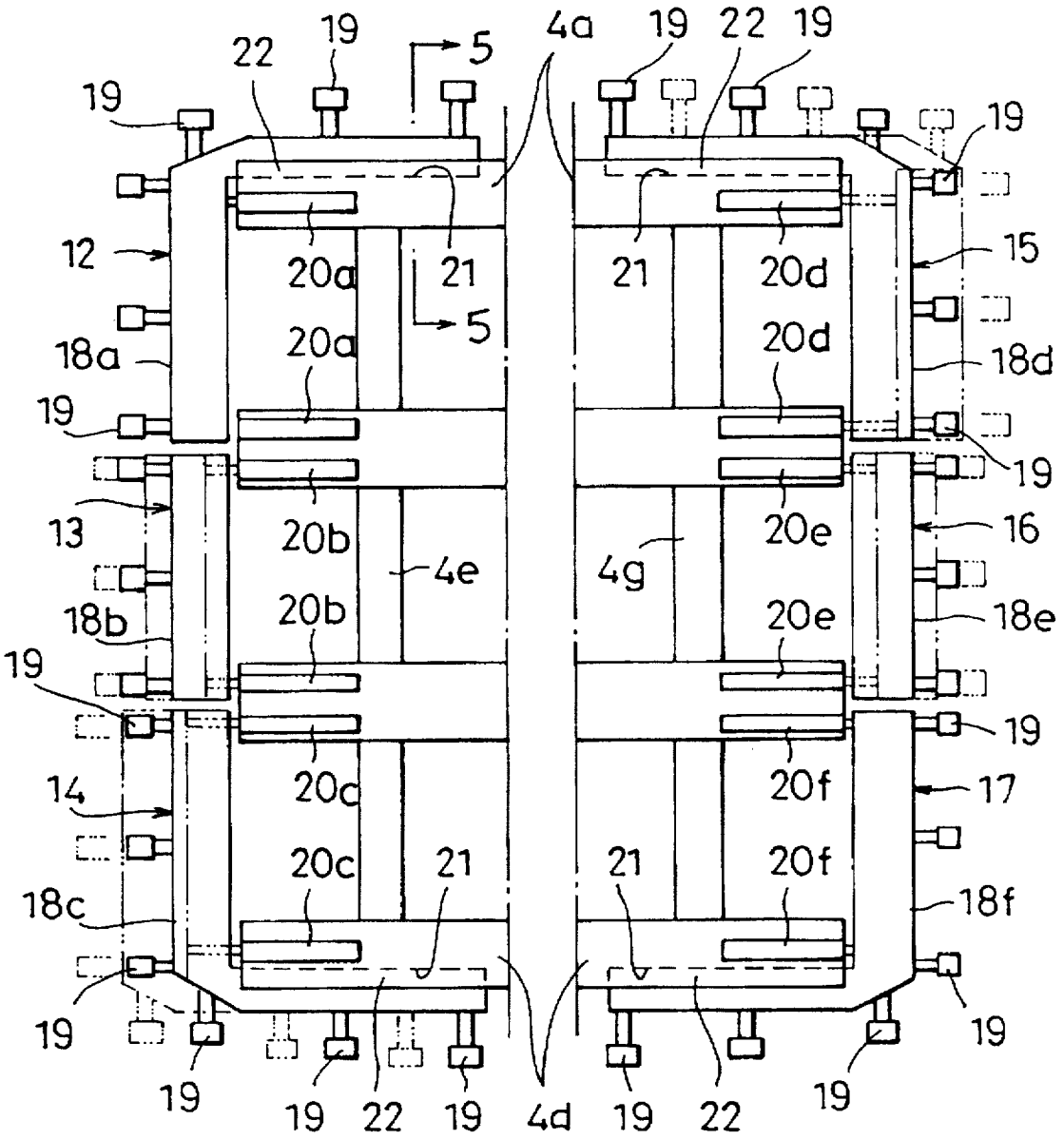
FIG. 4 is a fragmentary front view as magnified of a major part of the machine of FIG. 3.
Figure 5:
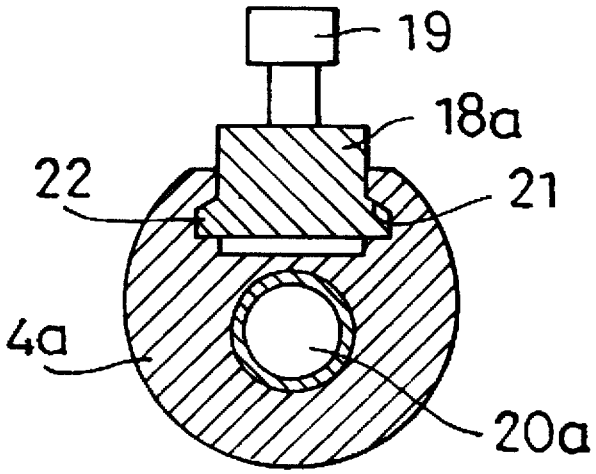
FIG. 5 is a fragmentary magnified cross sectional view of another major part in the machine of FIG. 3.
Figure 6:
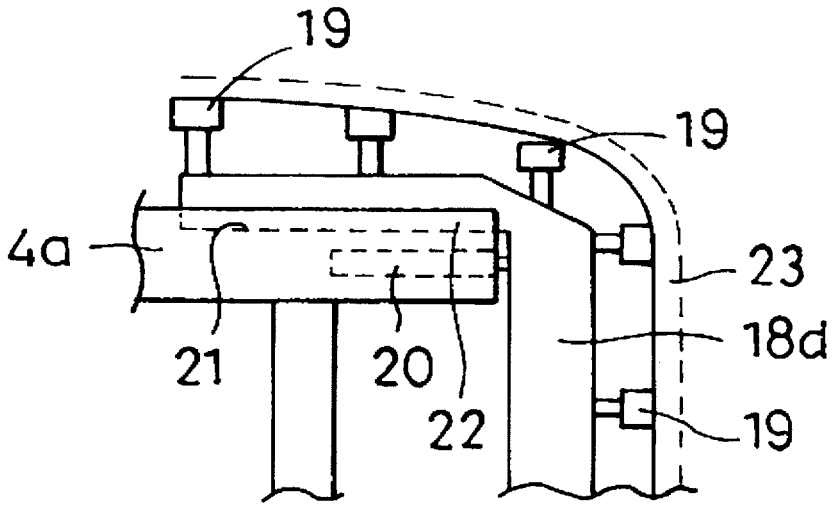
FIG. 6 is an explanatory view for the operation of the machine of FIG. 3.

In the event where an undesired change in direction, such as a rotation about the vertical, has occurred in the shield tunnel boring machine during the tunnel boring operation so that the shield tunnel boring machines makes an undesired turn to the right or left, it is necessary to correct the position of the shield tunnel boring machine so that the tunnel is bored in the desired direction. The present invention includes apparatus for position control of the shield tunnel boring machine as described subsequently so that the change in direction can be optimally corrected. Where the error in direction has taken place in a leftward direction with respect the tunnel face, for example, the excess excavation rate of the excess excavating cutters 15 at the upper right side and of the excess excavating cutters 14 at the lower left side is increased by means of the jacks 20d and 20c in pairs as shown in FIG. 2, while the excavating rate of the excess excavating cutters 16 at the middle right side and of the excess excavating cutters 15 at the lower right side is gradually reduced stepwise by means of the jacks 20e and 20f. The excavating rate of the excess excavating cutters 13 at the middle left side and of the excess excavating cutters 12 at the upper left side is gradually reduced stepwise by means of the jacks 20b and 20a to execute the excess excavation under the control of the jack adjusting means. The position of the shield tunnel boring machine is thereby controlled to move to the right side to correct for the undesired turn to the left.

In the case when the undesired turn of the shield tunnel boring machine takes place rightward with respect to the tunnel face, the excess excavation rate of the excess excavating cutters 12 at the upper the left side and of the excess excavating cutters 17 at the lower right side is made to be the largest by means of the jacks 20a and 20f while the excess excavation rate of the excess excavating cutters 13 at the middle left side and of the excess excavating cutters 14 at lower the left side is gradually reduced stepwise by means of the jacks 20b and 20c. The excess excavation rate of the excess excavating cutters 16 at the middle right side and of the excess excavating cutters 15 at the upper right side is gradually reduced stepwise by means of the jacks 20*e* and 20*d* and the necessary excess excavation is thus executed, whereby the position of the shield tunnel boring machine is controlled to move leftward so as to correct for the undesired right turn.

With the above operation performed, an operator of the shield tunnel boring machine may effectively accomplish the tunnel boring while reliably executing the position control of the shield tunnel boring machine even in the event of an undesired directional change of the machine takes place either leftward or rightward, irrespective of the extent of the undesired directional change. It should be further appreciated that the above arrangement for the position control is effectively applicable to the boring of a curved tunnel.

In FIGS. 3 to 6, there is shown a second embodiment of the shield tunnel boring machine according to the present invention in which substantially the same constituent members as those in the foregoing embodiment of FIG. 1 are denoted by the same reference numbers. In the present second embodiment, the cutter spokes 18*a*, 18*c*, 18*d* and 18*f* of the cutters 12, 14, 15 and 17 corresponding to corner parts of the parallel link excavator 2, in the excess excavating cutters 12–17 are formed to have an L-shaped angular shape. The cutter bits 19 are mounted respectively at optimum intervals to the outer surfaces of the spokes 18*a*, 18*c*, 18*d* and 18*f*, that is, to the top and side surfaces of the cutter spokes 18*a* and 18*d* as well as the side the lower surfaces of the cutter spokes 18*c* and 18*f*, The upper and lower side horizontal cutter spokes 4*a* and 4*d* of the cutters 4 are provided respectively with an engaging groove 21 whereas the upper cutter spokes 18*a* and 18*d* and lower cutter spokes 18*c* and 18*f* are provided respectively with an engaging projection 22 that is engagable in the groove 21 of the upper and lower cutter spokes 4*a* and 4*d*, so that the upper and lower cutter spokes 4*a* and 4*d* are slidably coupled to the upper and lower cutter spokes 18*a*, 18*d* and 18*c*, 18*f*.

While in this second embodiment it is preferable to form the engaging groove 21 and engaging-projection 22 as a dovetail groove and a dovetail projection, respectively, it is not required to always employ such dovetail joint but possible to adopt any other suitable shape. Further, it is also possible to provide the engaging grooves 21 in the cutter spokes 18*a*, 18*d*, 18*c* and 18*f* and to form the engaging projections 22 on the side of the upper and lower cutter spokes 4*a* and 4*d* of the cutters 4.

In the shield tunnel boring machine of this second embodiment, the excess excavating cutters are operated and controlled in the manner described below in the event where an undesired change in direction has taken place during the tunnel boring operation of the shield machine and position control is to be executed to correct for the error in tunnel boring direction. Where the shield tunnel boring machine has turned in the leftward direction with respect to the tunnel face, the excess excavation rates of the lower left side cutters 14 comprising the angle shaped cutter spoke 18*c* and cutter bits 19 mounted thereto and of the upper right side cutter 15 comprising the angle shaped cutter spoke 18*d* and cutter bits 19 mounted thereto are adjusted by the jacks 20*c* and 20*d* to be the largest, while the excess excavation rates of the cutters 13 and 12 at the middle left side and upper left side and of the cutters 16 and 17 at the middle right side and lower right side are adjusted by the jacks 20*b*, 20*a*, 20*e*, and 20*f* to be gradually stepwise reduced.

At this time, the excess excavation is attained at lower the left side part of the tunnel being bored by means of the cutter bits 19 mounted to the cutter spokes 18*c* in the upper left side excess excavating cutter 14, and at the upper right side part of the tunnel being bored by means of the cutter bits 19 mounted to the cutter spoke 18*d* in the upper right side excess excavating cutter 15. Preferably, this excess excavation is carded out in a range 23 of an outline shown by the dotted line in FIG. 6. Therefore, the foregoing position control can be reliably executed for the shield tunnel boring machine.

When the shield tunnel boring machine has turned rightward with respect to the tunnel face, to the contrary, the upper left side excess excavating cutter 12 comprising the angle shaped cutter spoke 18*a* and cutter bits 19 mounted thereto as well as the lower right side excess excavating cutter 17 comprising the angle shaped cutter spoke 18*f* and cutter bits 19 mounted thereto are adjusted by the jacks 20*a* and 20*f* to be the largest in the excess excavation rate, while the middle and lower left side excess excavating cutters 13 and 14 and the middle and the upper right side excess excavating cutters 16 and 15 are adjusted by the jacks 20*b*, 20*c*, 20*e* and 20*d* so as to be gradually stepwise reduced in the excess excavation rate.

Consequently, the necessary excess excavation can be attained at the upper left side part of the tunnel being bored by means of the cutter bits 19 mounted to the cutter spoke 18*a* in the upper left side excess excavating cutter 12, and at the lower right side part of the tunnel being bored by means of the cutter bits 19 mounted to the cutter spoke 18*f* in the lower right side excess excavating cutter 17.

Also in the present second embodiment as has been described, the shield tunnel boring machine can be optimally subjected to position control in the event of undesired turning to either the left or right for correcting the undesired directional change. Further, with this position control arrangement utilized, the machine is readily enabled to execute the boring of a curved tunnel by having the excess excavation cutters on the inside of the curve have a greater excess excavation rate than the excess excavation cutters on the outside of the curve.

In the present second embodiment, in addition, it is made possible to control the excess excavation rate in a smooth manner by means of a slidable coupling through the engaging groove 21 and projection 22 between the upper left side and right side cutter spokes 4*a* and 4*d* of the cutters 4 and the cutter spokes 18*a* and 18*d* of the upper left side and right side excess excavating cutters 12 and 15, and by means of a slidable coupling between the lower left side and right side cutter spokes 4*c* and 4*f* of the cutters 4 and the cutter spokes 18*c* and 18*f* of the lower left side and right side excess excavating cutters 14 and 17. Other components and their functions in this second embodiment are substantially the same as those in the foregoing first embodiment.

Further, while in the foregoing embodiments the left side and right side excess excavating cutters have been described as being divided into three stages in the vertical direction, they are not required to be so limited but may be in two stages or in four or more stages.

Figure 7:
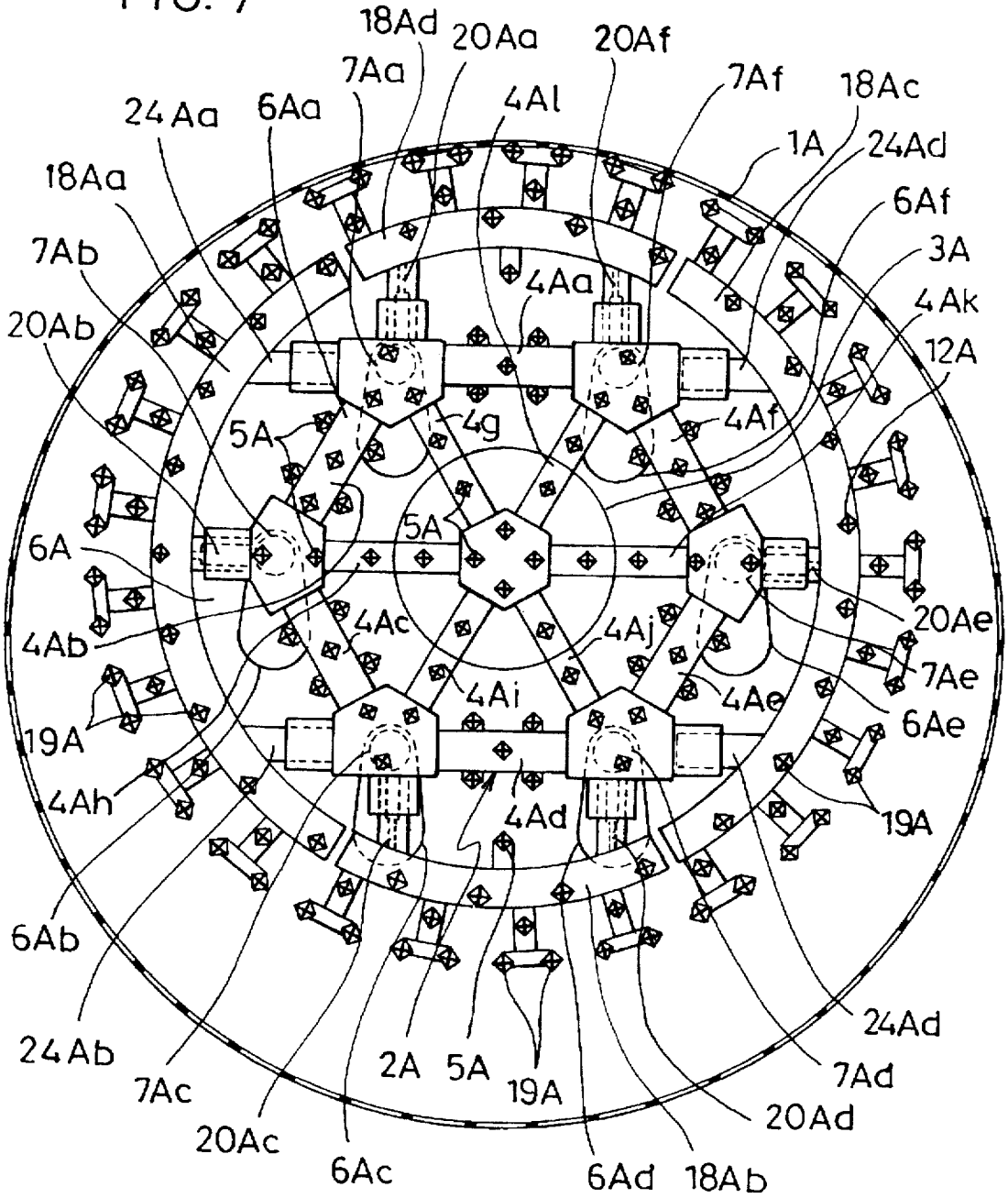
FIG. 7 is a front view of the shield tunnel boring machine in a third embodiment according to the present invention.

In FIG. 7, there is shown a third embodiment of the shield tunnel boring machine according to the present invention, in which the components performing substantially the same function as those in the foregoing embodiment of FIG. 1 are denoted by the same reference numbers but with a suffix "A" added. In this third embodiment, the parallel link excavator 2A is made to have a hexagonal outline, in which peripheral cutter spokes 4A*a*–4A*f* and inner radial cutter spokes 4A*g*–4A*l* are disposed respectively between adjacent ones of six corners and between each corner part and central part, and the cutters 4A for cutting the tunnel face ground are formed with these cutter spokes 4A*a*–4A*l*. At the respective corners of the hexagonal shape, the follower rotors 6A*a*–6A*f* are provided, and three of the cutter spokes jointed to the respective corner parts are pivoted thereto with the respective support shafts 7A*a*–7A*f*.

The cutter spokes 18A*a*–18A*d* forming the excess excavating cutters 12A surrounding the cutters 4A for the tunnel face are formed to be respectively arcuate, so as to form a circular shape in the outline as a whole. Between the cutters 4A for the tunnel face and excavating cutters 12A, the jacks 20A*a*–20A*f* are disposed to be positioned at the corners of the hexagonal shape, and slide guides 24A*a*–24A*d* are disposed between both ends of the upper and lower cutter spokes 4A*a* and 4A*d* of the tunnel face cutter device 4A and two excess excavating cutter spokes 18A*a* and 18A*c*. Further, a number of the cutter bits 5A and 19 A are mounted to the respective cutter spokes 4A*a*–4A*l* and 18A*a*–18A*d*.

In addition, the parallel link excavator 2A for cutting the tunnel face and the excess excavating cutters 12A are accommodated in the shield cylinder 1A as deviated as a whole from the center of the cylinder 1A to radially outward.

As the motive rotor 3A is actuated in the construction of the third embodiment, the parallel link excavator 2A and excess excavating cutters 12A are rotated with their rotary center sequentially deviated within the shield cylinder 1. The parallel link excavator 2A is operated to rotate while maintaining the parallel link connection though slightly different in the aspect of the parallel link motion from that in the fast and second embodiments, and the tunnel face ground is excavated by means of the many cutter bits 5A mounted to the cutters 4A. When the cutter spokes 18A*a*–18A*d* of the excess excavating cutters 12A are actuated simultaneously with the excavation of the tunnel face ground with the tunnel-face cutters 4A, the excess excavation is also executed.

In an event where the leftward turning of the shield tunnel boring machine has occurred during the boring operation, the excess excavation is executed with the excess excavation rate of the right side cutter spokes 18A*c* made the largest, and with the excess excavation rate of the upper and lower cutter spokes 18A*d* and 18A*b* and the left side cutter spoke 18A*a* gradually reduced stepwise, and the leftward turning can be corrected. When the turning takes place rightward, on the other hand, the excess excavation rate with the left side cutter spoke 18Aa is made the largest, while the excess excavation rate at the upper and lower cutter spokes 19A*d* and 18A*b* and the right side cutter spoke 18A*c* is reduced gradually stepwise, and the excess excavation is thus performed, so as to be able to correct the rightward turning.

Further, with this position controlling arrangement utilized, the boring of a curved tunnel can be easily executed in the same manner as in the foregoing first and second embodiments.

All other constituents and their functions in the present third embodiments are substantially the same as those in the foregoing first and second embodiments.

Further, while in the third embodiment the arcuate cutter spokes of the excess excavating cutter 12A is described as divided into four sections, the arrangement is not required to be so limited but may be in three or less sections or five or more sections.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A shield tunnel boring machine, comprising:

a parallel link excavator including a plurality of tunnel face cutters including a plurality of cutter spokes arranged for performing, when driven as a whole, a planar rotation through parallel movement of a plurality of driven-points;

an excess excavating cutter including a plurality of cutter spokes provided at parts of the periphery of said parallel link excavator, with pairs of said cutter spokes arranged to oppose each other with respect to the center of said planar rotation of the excavator for contributing to normal tunnel excavation of the machine in a desired sectional tunnel shape, said cutter spokes being mounted movably with respect to the parallel link excavator;

a plurality of cutter bits mounted mutually separated to the respective cutter spokes of the tunnel-face cutters and excess excavating cutter;

a plurality of jacks respectively coupled to the cutter spokes of the excess excavating cutter and respectively driven independently; and means coupled to the respective jacks for independently selectively adjusting the jacks to project selected ones of the cutter spokes of the excess excavating cutters by a desired amount on a desired side of the axis of the desired sectional tunnel shape for executing an excess excavation for directional control of the tunnel excavation.

2. The shield tunnel boring machine according to claim 1 wherein the respective cutter spokes of the parallel link excavator are provided to form a rectangular shape as a whole and the respective cutter spokes of the excess excavating cutter are disposed symmetrically on both longer sides of the rectangular parallel link excavator.

3. The shield tunnel boring machine according to claim 2 wherein some of the cutter spokes of the excess excavating cutter which are disposed at corner portions of the rectangular shape of the parallel link excavator are formed in an angled shape and are held slidably to corresponding cutter spokes of the parallel link excavator at the corner portions.

4. The shield tunnel boring machine according to claim 1 wherein the cutter spokes of the parallel link excavator are provided to form a polygonal shape as a whole, and the cutter spokes of the excess excavating cutter are provided to form a substantially circular shape along the periphery of the parallel link excavator.

5. The shield tunnel boring machine according to claim 4 wherein a pair of peripheral cutter spokes of the excess excavating cutter in the substantially circular shape are arranged in opposing diametrical relationship.

6. The shield tunnel boring machine according to claim 4 wherein the cutter spokes of the excess excavating cutter in the substantially circular shape comprise two pairs of radial cutter spokes extending radially from the center of the parallel link excavator.

* * * * *